US011503923B2

(12) United States Patent
Hinton

(10) Patent No.: US 11,503,923 B2
(45) Date of Patent: Nov. 22, 2022

(54) CO-SLEEPING COMFORTER FOR INFANT PROTECTION

(71) Applicant: Danyelle Hinton, Sandy, UT (US)

(72) Inventor: Danyelle Hinton, Sandy, UT (US)

( * ) Notice: Subject to any disclaimer, the term of this patent is extended or adjusted under 35 U.S.C. 154(b) by 0 days.

(21) Appl. No.: 16/518,029

(22) Filed: Jul. 22, 2019

(65) Prior Publication Data

US 2021/0022525 A1 Jan. 28, 2021

(51) Int. Cl.

| | |
|---|---|
| ***A47D 15/00*** | (2006.01) |
| ***A47G 9/02*** | (2006.01) |
| *A47G 11/00* | (2006.01) |

(52) U.S. Cl.

CPC ..... *A47D 15/00* (2013.01); *A47G 9/02* (2013.01); *A47G 9/0207* (2013.01); *A47G 9/0223* (2013.01); *A47G 11/006* (2013.01); *A47G 2009/0276* (2013.01)

(58) Field of Classification Search

CPC ..... A47G 9/02; A47G 9/0207; A47G 9/0223; A47G 9/023; A47G 9/0238; A47G 9/00; A47G 2009/0276; A47G 9/0284; A47G 9/08; A47G 11/006

See application file for complete search history.

(56) References Cited

U.S. PATENT DOCUMENTS 1,863,256 A * 6/1932 Snoddy ..... A47G 9/083 5/494
2,627,617 A * 2/1953 Avila ..... A47G 9/0238 5/494
2,689,961 A * 9/1954 Lieberthal ..... A47G 9/023 5/486
3,729,037 A 4/1973 Dare
5,868,465 A 2/1999 Kvalvik
6,135,635 A * 10/2000 Miller ..... A45F 4/02 224/584
6,142,565 A 11/2000 Rieder
6,428,098 B1 8/2002 Allbaugh
6,490,741 B1 * 12/2002 Wheeler ..... A47G 9/02 5/494
6,532,595 B1 3/2003 Holmes
6,676,210 B1 1/2004 Peyton
6,929,326 B2 8/2005 Cohen-Fyffe
7,156,458 B2 1/2007 Hanberg
7,240,964 B2 7/2007 Riley
7,878,587 B1 2/2011 Leach
8,556,343 B2 10/2013 Rubinshteyn
(Continued)

OTHER PUBLICATIONS

"Blanket." Lexico—Oxford English and Spanish Dictinonary, Lexico, www.lexico.com/en/definition/blanket.*

*Primary Examiner* — David R Hare
*Assistant Examiner* — Madison Emanski
(74) *Attorney, Agent, or Firm* — Morriss O'Bryant; Compagni Cannon, PLLC

(57) ABSTRACT

The present invention is a system and method for providing a comforter that is divided into three sections or panels, wherein a center panel of the comforter may be pulled down while allowing the remaining two outer panels to remain up and on top of the other occupants of the bed on either side of the center panel, wherein a small infant sleeper crib may be placed in the gap between the two outer panels of the comforter without any danger of the infant being covered by the center panel.

7 Claims, 8 Drawing Sheets

(56) References Cited

U.S. PATENT DOCUMENTS

| | | | | |
|---|---|---|---|---|
| 8,561,228 | B2 * | 10/2013 | West | A47G 9/0238 5/494 |
| 2004/0207239 | A1 | 10/2004 | King | |
| 2005/0057080 | A1 | 3/2005 | Collins | |
| 2005/0110315 | A1 | 5/2005 | Littlehorn | |
| 2006/0071519 | A1 * | 4/2006 | Heide | A47C 31/11 297/219.1 |
| 2008/0079297 | A1 | 4/2008 | Braxton | |
| 2009/0189425 | A1 | 7/2009 | Powell | |
| 2009/0199336 | A1 * | 8/2009 | Gentile | A47G 9/0223 5/486 |
| 2011/0252563 | A1 * | 10/2011 | Horstman | A47G 9/0207 5/486 |

* cited by examiner

CO-SLEEPING COMFORTER FOR INFANT PROTECTION

BACKGROUND

Field of the Invention

This invention relates generally to a blanket used on a bed, wherein the blanket is divided into sections that allow at least one section to be pulled down without disturbing the remaining sections and the comfort of the other sleepers, and thereby enabling an infant to be placed on the bed in the area where at least one section of the blanket has been pulled down without danger of covering and smothering the infant with the blanket.

Description of Related Art

A blanket or comforter as they are often called is used on a bed to cover all of the bed's occupants. When parents are sleeping in the same bed the comforter is typically of a larger size because the bed is typically larger and there are more occupants to cover.

Now consider the situation in a bed with two parents and an infant is brought into the bed. It is often the case that an infant, defined here as a newborn, a baby or a very young child, may be brought into the parent's bed during the night for various reasons. These reasons are not relevant to the invention, but may include such situations as providing comfort to a crying infant, bringing an infant closer for nursing or feeding, lack of an infant crib, etc. What is important is that the infant may be young and/or small and may lack the ability to push a comforter off if the comforter has covered the infant.

Statistics show that over 60% of mothers may bring an infant into their bed during the night to sleep. This situation is often referred to as co-sleeping. Over 40% of mothers may also use soft bedding materials such as a comforter around the infant. Unfortunately, there are approximately 3,500 sleep-related infant deaths each year in the United States alone, with many being attributed to accidental suffocation.

Parents are encouraged by the Centers for Disease Control and Prevention to share a room with the infant, but not the same bed in order to reduce the risk of harm. Nevertheless, parents continue to bring infants into the bed despite the risks of harm or death.

It would be an advantage over the prior art to provide a comforter that, by its design, may be able to keep a significant portion of it away from an infant to enable safer co-sleeping. It would be another advantage over the prior art to provide a comforter that still covers the other occupants of the bed.

BRIEF SUMMARY

The present invention is a system and method for providing a comforter that is divided into three sections or panels, wherein a center panel of the comforter may be pulled down while allowing the remaining two outer panels to remain up and on top of the other occupants of the bed on either side of the center panel, wherein a small infant sleeper crib may be placed in the gap between the two outer panels of the comforter without any danger of the infant being covered by the center panel.

In a first aspect of the invention, a comforter is divided into three sections or panels, wherein the center panel may be pulled down to allow placement of an infant in a small baby sleeper in the gap between the two outer panels.

These and other embodiments of the present invention will become apparent to those skilled in the art from a consideration of the following detailed description taken in combination with the accompanying drawings.

DETAILED DESCRIPTION

Reference will now be made to the drawings in which the various embodiments of the present invention will be discussed so as to enable one skilled in the art to make and use the invention. It is to be understood that the following description illustrates embodiments of the present invention and should not be viewed as narrowing the claims which follow. It should also be understood that the terms blanket, sheet and comforter may be used interchangeably throughout the rest of this document.

Figure 1:
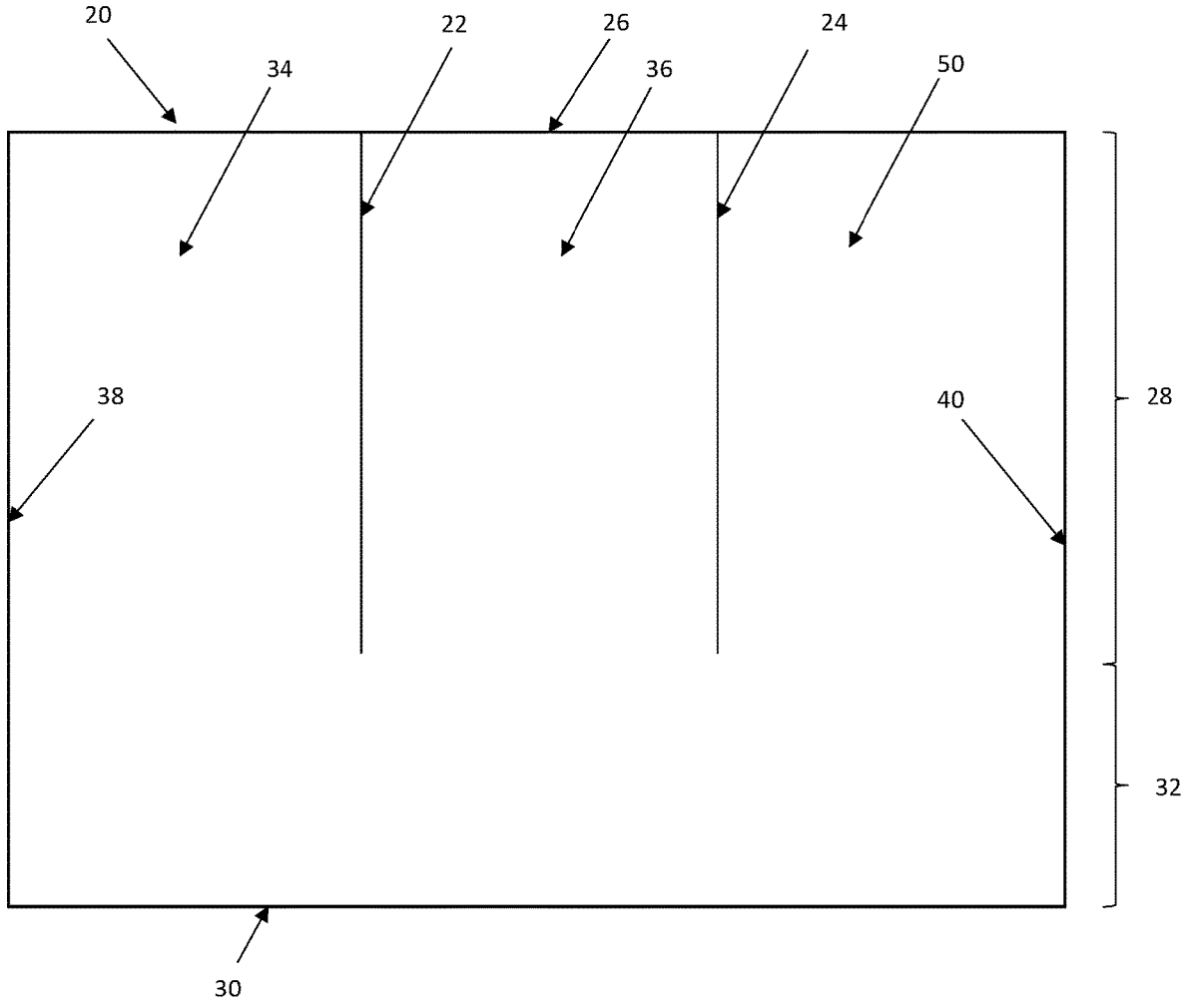
FIG. 1 is a top view of a first embodiment of the present invention, wherein a comforter is divided into three panels.

FIG. 1 is a top view of a first embodiment of the present invention. This figure shows a comforter 20 having two seams 22, 24 extending from a top edge 26 in a top portion 28. The two seams 22, 24 extend partially down the length of the comforter 20 in the top portion 28 but not into a bottom portion 32. Thus, none of the seams 22, 24 extend all the way to a bottom edge 30. Accordingly, the comforter 20 remains an undivided comforter on the bottom portion 32.

When the two seams 22, 24 are closed, the entire comforter 20 may form a single panel. In contrast, when the two seams 22, 24 are both open, the top portion 28 of the comforter 20 may be divided into three sections or panels. The three panels are the two outer panels 34, 50 and a middle panel 36.

The length of the top portion 28 and the bottom portion 32 may be defined by the length of the seams 22, 24. The length of the two seams 22, 24 may be adjusted to create panels 34, 50, 36 of a desired length. However, it should also be understood that in order to maintain the integrity of the comforter 20, the two seams 22, 24 may not extend the entire length of the comforter.

This first embodiment shows that the seams 22, 24 may be equidistant from each other and the right and left edges 38, 40 of the comforter 20. However, the seams 22, 24 may also not be spaced equidistantly but may instead have some other spacing.

Figure 2:
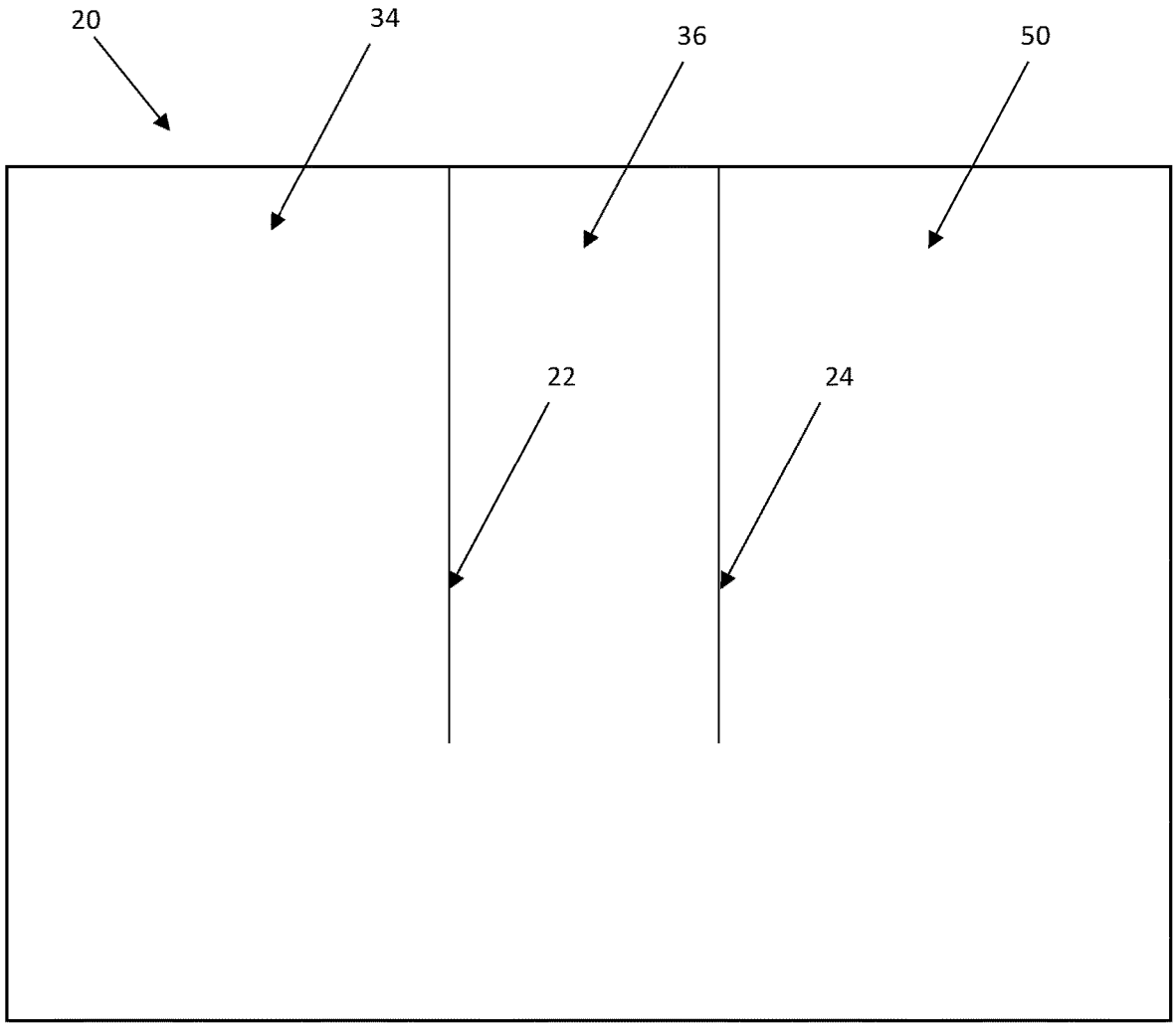
FIG. 2 is a modification of the first embodiment that provides a smaller center panel.

For example, in an alternative embodiment shown in FIG. 2, the seams 22, 24 may be closer to each other and farther from the right and left edges 38, 40 such that the middle panel 36 of the comforter 20 may be thinner relative to the two outer panels 34, 50.

The seams 22, 24 may be made of any appropriate materials that enables them to be opened and closed as desired. For example, the seams 22, 24 may be made from the group of seam materials including but not limited to a zipper, Velcro™, ribbon ties, snaps, etc. Thus, the seams 22, 24 may form a tight seal using a zipper or Velcro™ or may be less tightly shut by using a ribbon tie. What is important is that the seams 22, 24 need to be able to be opened and closed so that the middle panel 36 of the comforter 20 may be lowered as needed.

The purpose of lowering the middle section 36 of the comforter 20 may be to prevent the middle section 36 from accidentally covering whatever person is lying in the middle of the bed. This person may be a small child or an infant. By enabling the middle panel 36 to be lowered while the two outer panels 34, 50 remain up, the comfort of those in the bed can be maintained while the safety of the person in the middle may be assured.

As a practical matter, the first embodiment of the invention may also include a feature to make certain that the middle panel 36 is not accidentally pulled upwards while an infant is in the bed. This feature may be ribbons or some other fastening device to secure the middle panel 36 in place after it has been pulled down towards the bottom edge 30 of the comforter 20.

Figure 3:
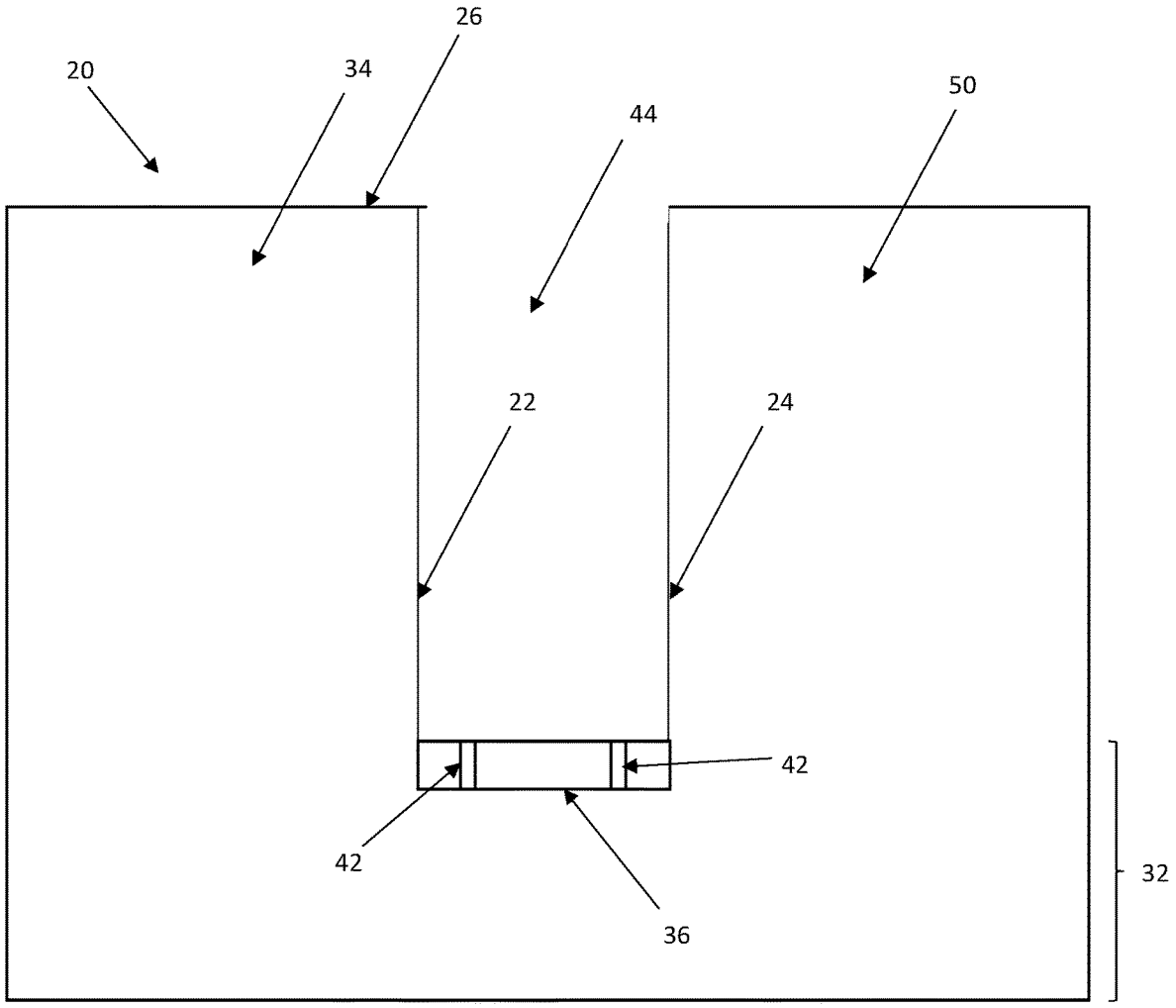
FIG. 3 is a top view of a comforter showing how the center panels is rolled down and secured in place at a bottom section of the comforter.

FIG. 3 is a top view of the comforter 20 which shows that the middle panel 36 may be rolled toward the bottom edge 30 of the comforter when the two seams 22, 24 have been opened. The rolled middle panel 36 may then be secured to the comforter using any securing system 42 that will hold the rolled middle panel in place at the bottom of the top portion. The securing system may be ribbon ties, snaps or any other convenient way to secure the middle panel 36.

While FIG. 3 shows two ribbon ties 42 being used to secure the rolled up middle panel 36, it should be understood that there may be a single ribbon tie 42 or a plurality, and this should not be considered as a limiting factor of the first embodiment.

It should also be noted that the middle panel 36 may not be rolled but may be folded in any manner that enables it to be secured to the comforter using the securing system 42.

Another problem that may be solved by providing a system such as the ribbon ties 42 for securing the middle panel 36 to the bottom portion 32 of the comforter 20, is preventing the comforter from being dragged off the bed. Therefore, the location of the ribbon ties 42 should be far enough towards the top edge 26 of the comforter 20 such that the rolled up middle panel 36 is not hanging over a bottom edge of the bed. By placing the ribbon ties 42 far enough from the bottom edge of the bed, the rolled up middle panel 36 may actually function to hold the comforter 20 in place.

Although it is not a claimed feature of the first embodiment, it is recommended that any infant placed in the gap 44 created by the rolled down middle panel 36 as shown in FIG. 3 should be in a separate baby sleeping device such as an infant sleeper bed.

The first embodiment shown in FIGS. 1, 2 and 3 demonstrate that the middle panel 36 may be rolled down to create a gap in the middle of the comforter 20. However, it should be understood that there may be other configurations of the comforter 20.

Figure 4:
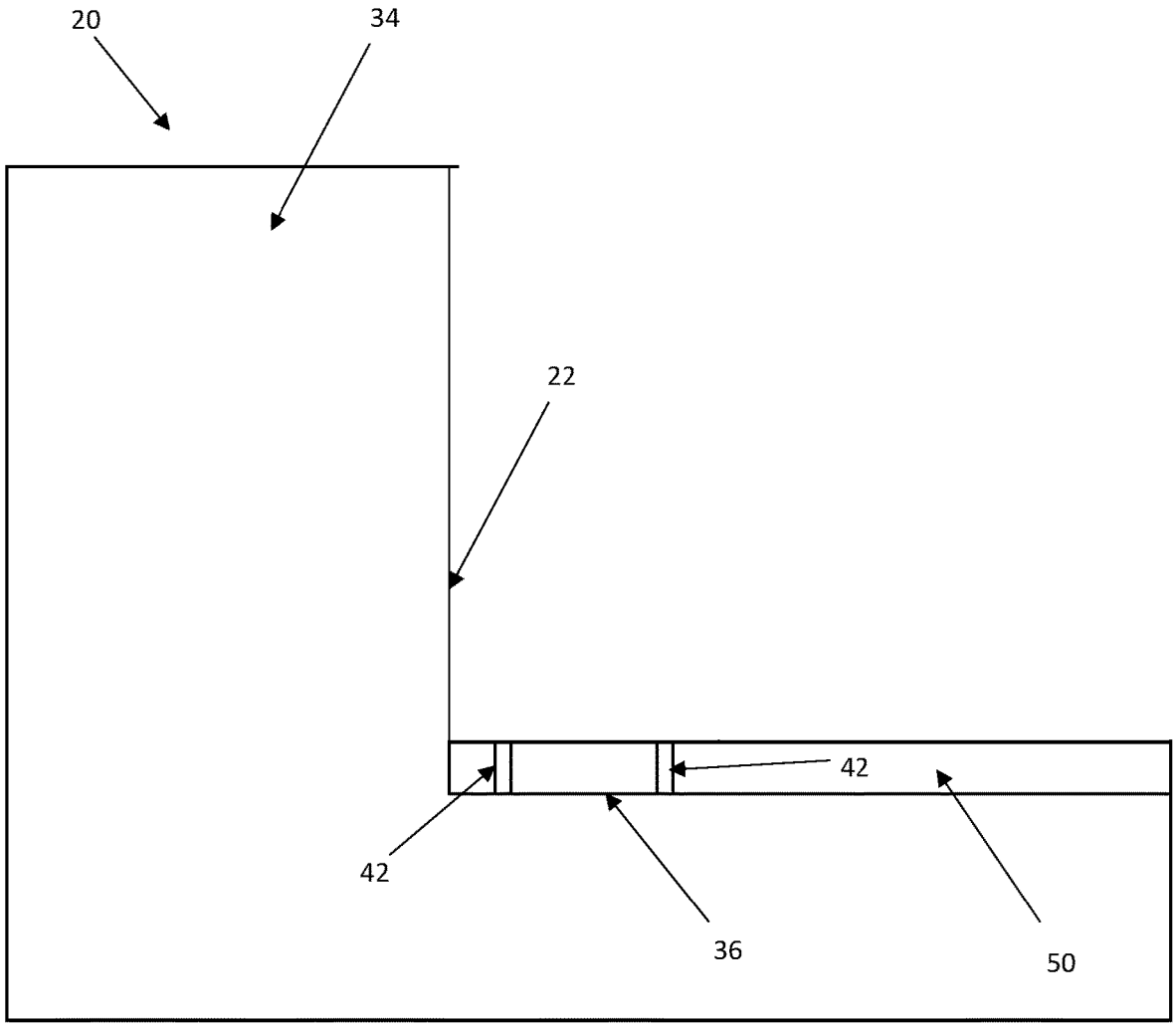
FIG. 4 is a top view of a comforter with the center panel and one outer panel pulled down and secured together in a bottom portion of the comforter.

For example, FIG. 4 shows in a second embodiment that one of the seams 22, 24 is not opened up. In this figure seam 22 is opened but seam 24 is kept closed. The middle panel 36 may then be rolled down along with the outer panel 50. Alternatively, seam 24 may be opened and seam 22 may be kept closed. The middle panel 36 may then be rolled down along with the outer panel 34.

It should be understood that an infant should only be placed in the open area created by the rolling down of the middle panel 36 and the outer panel 50.

Figure 5:
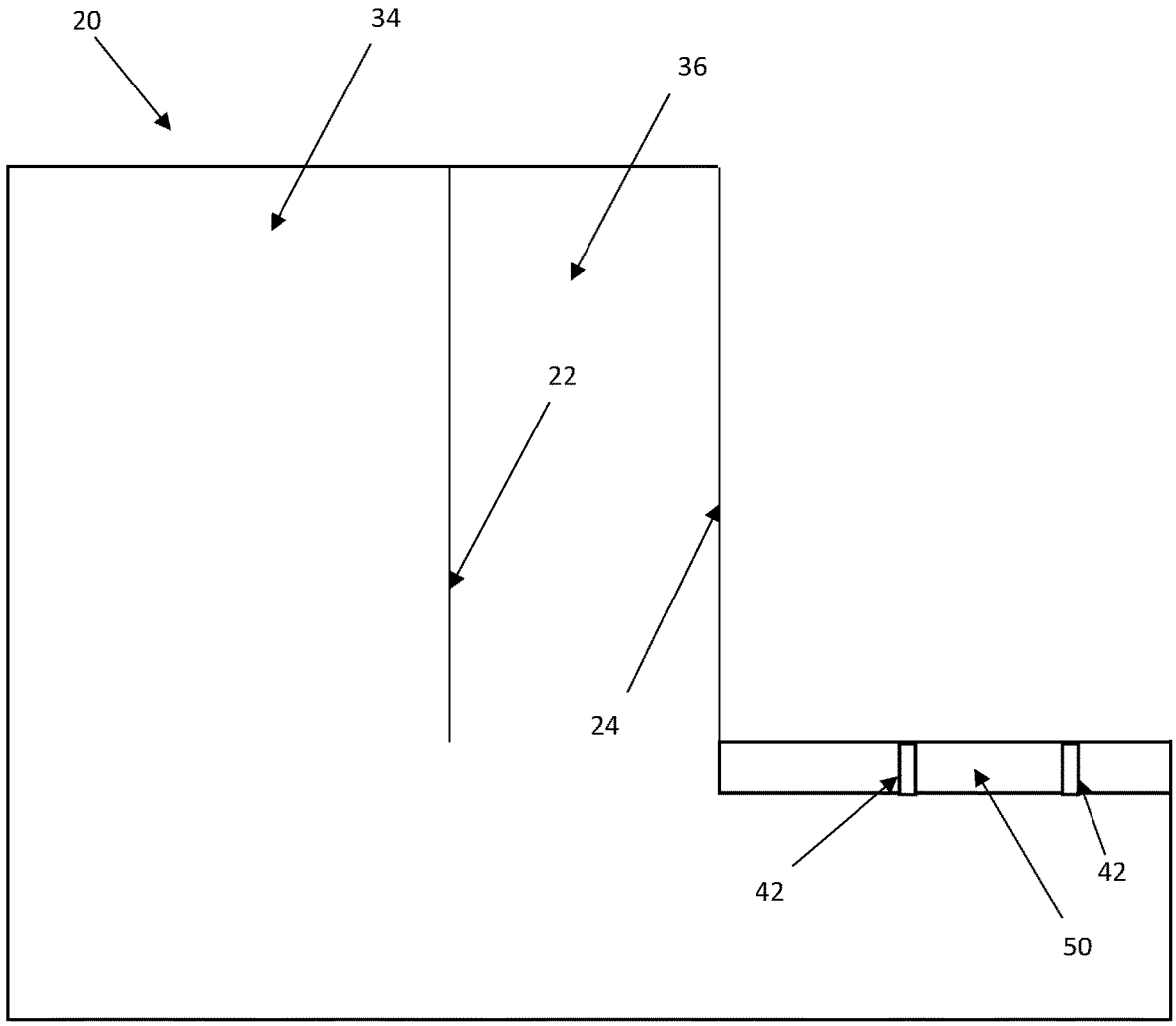
FIG. 5 is a top view of the comforter with only one outer panel pulled down and secure to the bottom section of the comforter.

A third embodiment of the invention is shown in FIG. 5. FIG. 5 shows that the middle panel 36 of confuter 20 may not be rolled down but is kept unrolled and connected to the outer panel 34 by seam 22. Outer panel 50 may be rolled down and secured using any convenient system such as the ribbon ties 42.

It should be understood that an infant should only be placed in the open area created by the rolling down of the outer panel 50.

Figure 6:
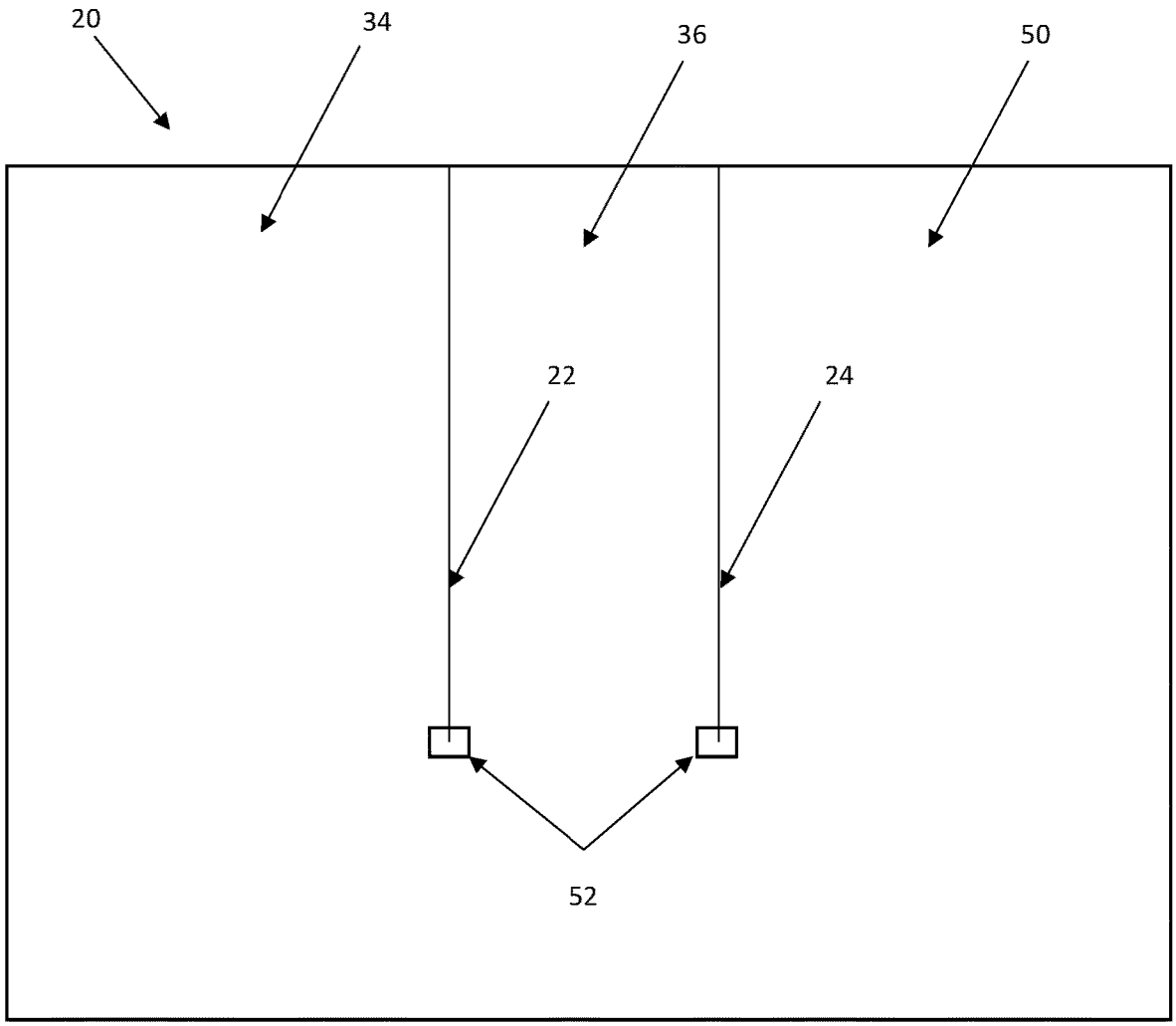
FIG. 6 is a top view of the comforter showing placement of reinforcement patches to prevent tearing of the comforter.

All of the embodiments of the invention may also include a feature to prevent damage to the comforter 20. Specifically, FIG. 6 shows that reinforcement of the comforter 20 may be necessary at the location where the seams 22, 24 terminate within the comforter 20. For example, FIG. 6 shows reinforcement patches 52 may be used to reinforce the material of the comforter 20 and preventing tearing.

Figure 7:
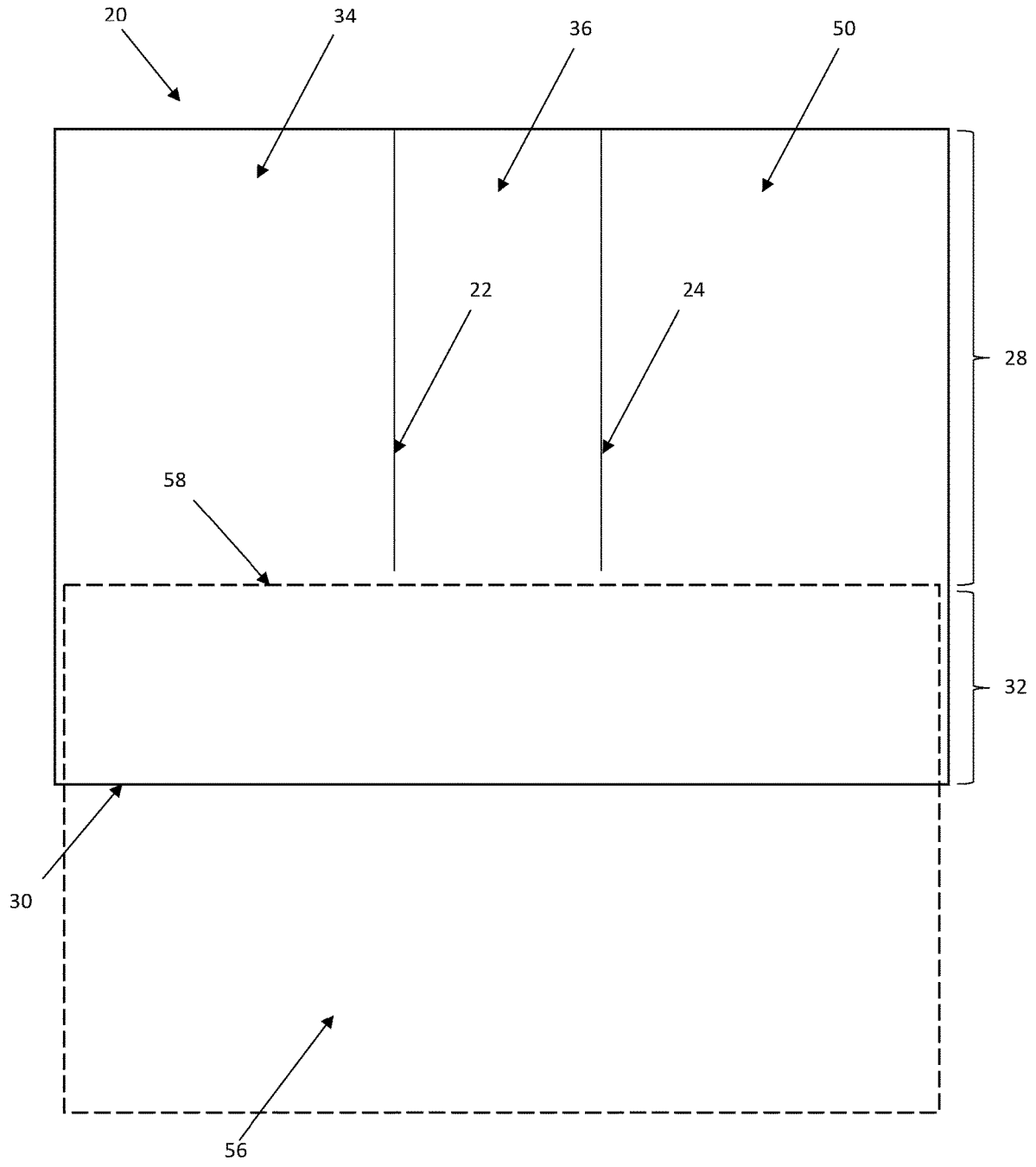
FIG. 7 is a top view of an alternative embodiment of the invention that provides a cover panel to cover the seams in the comforter.

FIG. 7 shows another modification that may be added to any of the embodiments of the invention. Specifically, FIG. 7 shows a top view of the comforter 20 with seams 22, 24 forming middle panel 36 and outer panels 34, 50. An additional cover panel 56 (shown in dotted outline) may be attached to the comforter 20 just below the end of the seams 22, 24 along edge 58. The cover panel 56 may typically be pulled down over the bottom portion 32 when the comforter 20 is in use.

The purpose of the cover panel 56 may be to provide a more aesthetically pleasing covering over the top portion 28 of the comforter 20 when the middle panel 36 has not been pulled down. For example, the cover panel 56 may be pulled over the top portion 28 when the bed is unoccupied. The cover panel 56 may also be pulled over the top portion 28 when the bed is not being occupied by an infant.

Figure 8:
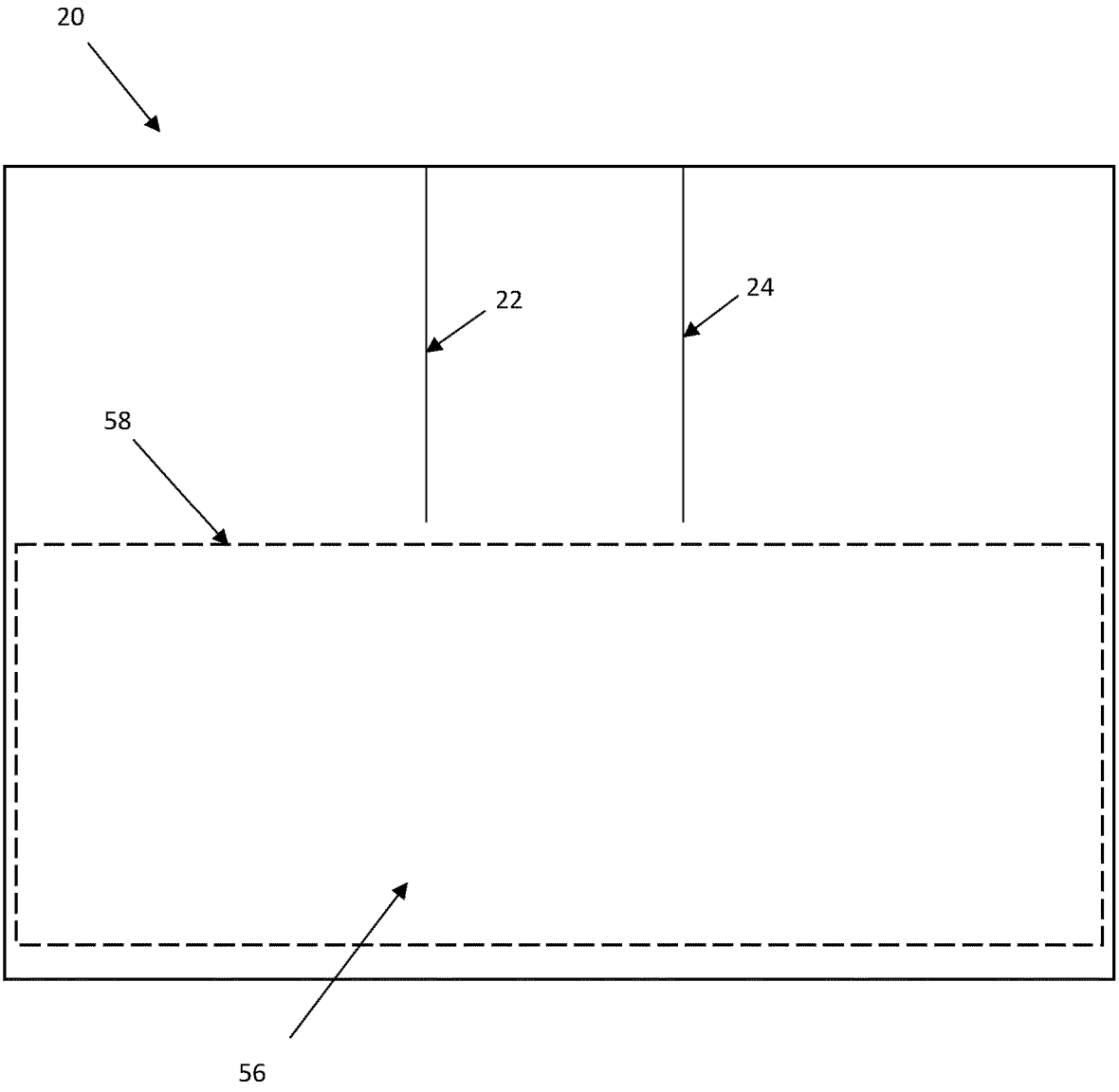
FIG. 8 is a top view of the alternative embodiment of the invention shown in FIG. 7 but with shorter seams and cover panel.

It should also be understood that the cover panel 56 does not have to extend beyond the bottom edge 30 of the comforter 20 if the two seams 22, 24 are less than half of the length of the comforter. This is shown in FIG. 8 where the edge 58 is near a midpoint of the length of the comforter 20.

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims. It is the express intention of the applicant not to invoke 35 U.S.C. § 112, paragraph 6 for any limitations of any of the claims herein, except for those in which the claim expressly uses the words 'means for' together with an associated function.

What is claimed is:

1. A comforter that is divided into panels so that a center panel can be moved to prevent it from covering a person, said comforter comprised of: a rectangular comforter having a top edge and a bottom edge, wherein the comforter is also divided into a top portion having the top edge and a bottom portion having the bottom edge; a first seam that extends from the top edge and all the way along a length of the top portion but not into the bottom portion, and wherein the first seam may be open or closed along a length thereof; and a second seam that extends from the top edge and all the way along a length of the top portion but not into the bottom portion, wherein the first seam may be open or closed along a length thereof, wherein the first seam is parallel to the second seam, wherein the first seam and the second seam divide the top portion of the comforter into three panels which are a right outer panel, a left outer panel, and a middle panel; at least one middle panel securing system configured to secure the middle panel to the comforter after the middle panel is rolled from the top edge towards the bottom edge of the comforter, wherein the middle panel securing system is disposed where the top portion of the comforter meets the bottom portion of the comforter; at least one right outer panel securing system configured to secure the right outer panel to the comforter after the right outer panel is rolled from the top edge towards the bottom edge of the comforter; and at least one left outer panel securing system configured to secure the left outer panel to the comforter after the left outer panel is rolled from the top edge towards the bottom edge of the comforter; and wherein the first seam and the second seam are open such that the middle panel is separated from the right and left outer panels, wherein the right outer panel does not overlap the middle panel, wherein the left outer panel does not overlap the middle panel, and wherein the middle panel is secured to the bottom portion of the comforter when the middle panel is rolled down.

2. The comforter as defined in claim 1 wherein the comforter is further comprised of a plurality of reinforcement patches to prevent tearing of the comforter, wherein a first reinforcement patch is disposed at a location where the first seam ends at an edge between the top portion and the bottom portion of the comforter, and wherein a second reinforcement patch is disposed at a location where the second seam ends at the edge between the top portion and the bottom portion of the comforter.

3. The comforter as defined in claim 1 wherein the comforter is further comprised of a rectangular cover panel, wherein the cover panel is coupled to the comforter along an edge where the top portion meets the bottom portion of the comforter, wherein the cover panel is a rectangular sheet of material does not extend beyond a left or right edge of the comforter, wherein the cover panel is folded over the top portion up to the top edge thereof when the first seam and the second seam are closed, and wherein the cover panel is folded over the bottom portion when the first seam or the second seam is open.

4. The comforter as defined in claim 1 wherein the first seam and the second seam are selected from the group of seam materials comprised of a zipper, hook and loop fastener, ribbon ties or snaps.

5. The comforter as defined in claim 1 wherein the top portion has a length that is equal to the bottom portion such that the top portion and the bottom portion each occupy approximately half of the comforter.

6. The comforter as defined in claim 1 wherein the top portion has a length that is greater than the length of the bottom portion.

7. The comforter as defined in claim 1 wherein the top portion has a length that is less than the length of the bottom portion.

* * * * *